US010831131B1

(12) United States Patent
Cavill et al.

(10) Patent No.: US 10,831,131 B1
(45) Date of Patent: Nov. 10, 2020

(54) DEVELOPER UNIT ASSEMBLY FOR RESTRICTING MOVEMENT OF A DEVELOPER ROLL END SEAL IN AN ELECTROPHOTOGRAPHIC IMAGE FORMING DEVICE

(71) Applicant: LEXMARK INTERNATIONAL, INC., Lexington, KY (US)

(72) Inventors: Gregory Alan Cavill, Winchester, KY (US); Richard Louis Goin, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 16/742,958

(22) Filed: Jan. 15, 2020

Related U.S. Application Data

(60) Provisional application No. 62/908,642, filed on Oct. 1, 2019.

(51) Int. Cl.
*G03G 15/08* (2006.01)

(52) U.S. Cl.
CPC ..... *G03G 15/0898* (2013.01); *G03G 15/0808* (2013.01); *G03G 15/0812* (2013.01)

(58) Field of Classification Search
CPC ..... G03G 15/0808; G03G 15/0812; G03G 15/0817; G03G 15/0898
See application file for complete search history.

(56) References Cited

U.S. PATENT DOCUMENTS

| | | | | |
|---|---|---|---|---|
| 4,616,919 | A * | 10/1986 | Adley | G03G 15/0898 399/103 |
| 5,057,868 | A | 10/1991 | Sekino et al. | |
| 5,212,521 | A | 5/1993 | Ogawa et al. | |
| 5,389,732 | A | 2/1995 | Sekino | |
| 5,475,467 | A | 12/1995 | Watanabe et al. | |
| 5,488,462 | A | 1/1996 | Ishikawa et al. | |
| 5,555,184 | A | 9/1996 | Jaskowiak et al. | |
| 5,870,651 | A | 2/1999 | Shimada | |
| 6,341,206 | B1 | 1/2002 | Yamaguchi et al. | |
| 6,487,383 | B2 | 11/2002 | Buchanan et al. | |
| 6,553,195 | B2 | 4/2003 | Korfhage et al. | |
| 6,591,074 | B1 | 7/2003 | Michlin | |
| 6,985,683 | B2 | 1/2006 | Foster et al. | |
| 6,996,353 | B2 | 2/2006 | Schell | |

(Continued)

*Primary Examiner* — Sophia S Chen

(57) ABSTRACT

A developer unit for an electrophotographic image forming device includes a developer roll rotatably mounted on a housing. The developer roll includes a shaft defining a rotational axis and a roll body cylindrically disposed around the shaft to form an outer circumferential surface of the developer roll. An end seal includes a curved rotary seal portion sandwiched between a pocket portion of the housing and the outer circumferential surface of the developer roll, such that an outer circumferential surface of the curved rotary seal portion contacts the pocket portion of the housing and an inner circumferential surface of the curved rotary seal portion contacts the outer circumferential surface of the developer roll. The pocket portion of the housing includes protrusions that contact the outer circumferential surface of the curved rotary seal portion to restrict movement of the end seal along an operative rotational direction of the developer roll.

7 Claims, 11 Drawing Sheets

(56) References Cited

U.S. PATENT DOCUMENTS

| | | | | |
|---|---|---|---|---|
| 7,177,565 | B1 * | 2/2007 | Miller | G03G 15/0817 399/103 |
| 7,239,824 | B2 | 7/2007 | Fukuta | |
| 7,539,438 | B2 | 5/2009 | van Leipsig et al. | |
| 7,561,820 | B2 | 7/2009 | Gayne et al. | |
| 7,623,807 | B2 | 11/2009 | Carter, II et al. | |
| 7,627,265 | B2 | 12/2009 | Gayne et al. | |
| 8,099,012 | B2 | 1/2012 | Askren et al. | |
| 8,116,657 | B2 | 2/2012 | Kant et al. | |
| 8,644,725 | B2 | 2/2014 | Brown et al. | |
| 8,886,080 | B2 | 11/2014 | Allen et al. | |
| 8,948,649 | B2 | 2/2015 | McCoy et al. | |
| 9,014,592 | B2 | 4/2015 | Fukamachi et al. | |
| 9,835,978 | B2 | 12/2017 | Castle et al. | |
| 10,365,586 | B1 | 7/2019 | Goin et al. | |
| 2001/0033757 | A1 * | 10/2001 | Sato | G03G 15/0817 399/103 |
| 2002/0141777 | A1 | 10/2002 | Kamimura et al. | |
| 2004/0001727 | A1 | 1/2004 | Akutsu | |
| 2006/0204273 | A1 | 9/2006 | Kawai | |
| 2007/0034099 | A1 | 2/2007 | Gayne et al. | |
| 2007/0071489 | A1 | 3/2007 | Nakaya et al. | |
| 2009/0274482 | A1 * | 11/2009 | Xu | G03G 15/0817 399/105 |
| 2013/0259514 | A1 * | 10/2013 | McCoy | G03G 15/0817 399/103 |
| 2016/0259271 | A1 | 9/2016 | Ooyoshi | |

* cited by examiner

DEVELOPER UNIT ASSEMBLY FOR RESTRICTING MOVEMENT OF A DEVELOPER ROLL END SEAL IN AN ELECTROPHOTOGRAPHIC IMAGE FORMING DEVICE

CROSS REFERENCES TO RELATED APPLICATIONS

This application claims priority to U.S. Provisional Patent Application Ser. No. 62/908,642, filed Oct. 1, 2019, entitled "Developer Unit Assembly for Restricting Movement of a Developer Roll End Seal in an Electrophotographic Image Forming Device," the content of which is hereby incorporated by reference in its entirety.

BACKGROUND

1. Field of the Disclosure

The present disclosure relates generally to electrophotographic image forming devices and, more particularly, to a developer unit assembly for restricting movement of a developer roll end seal.

2. Description of the Related Art

Sealing toner within an electrophotographic image forming device is important to provide the customer with a clean device and a cleanly printed page. Many of the seals present in electrophotographic image forming devices are static, and there is no motion of parts around the seal. However, seals positioned around the outer surface of the developer roll face additional challenges because of the rotation of the developer roll against the seal. These seals must be positioned accurately to effectively seal and must remain in their installed position during operation.

Rotation of the developer roll generates forces that act on the seals, e.g., due to friction of the sealing surface of the seals against the rotating developer roll. Since the developer roll is not perfectly round, the seals must accommodate this varying geometry with some force to retain toner while also reacting to changes of the diameter of the developer roll. Although the sealing force is relatively small, it can affect the position of the seal. Shear force generated from the developer roll continually forces to pull the seal around the roll. The seal counteracts the shear force but, in some seals, the internal seal structure is not rigid enough to resist the shear force.

Accordingly, an improved positioning of the seal against the outer surface of the developer roll is desired.

SUMMARY

The developer unit disclosed here for an electrophotographic image forming device addresses the above mentioned need for improved positioning of the seal against the outer surface of the developer roll. The developer unit includes a housing, a developer roll, an end seal, and a pocket portion formed on the housing. The developer roll is rotatably mounted on the housing and the developer roll includes a shaft that defines a rotational axis of the developer roll. The developer roll also includes a roll body cylindrically disposed around the shaft and forming an outer circumferential surface of the developer roll. The end seal includes a curved rotary seal portion, which is sandwiched between a pocket portion of the housing and the outer circumferential surface of the developer roll.

The end seal is sandwiched as mentioned above, such that an outer circumferential surface of the curved rotary seal portion contacts the pocket portion of the housing and an inner circumferential surface of the curved rotary seal portion contacts the outer circumferential surface of the developer roll. The pocket portion of the housing includes multiple protrusions that are in contact with the outer circumferential surface of the curved rotary seal portion, where the protrusions restrict movement of the end seal along an operative rotational direction of the developer roll. In some embodiments, the pocket portion is integrally formed with the housing.

As used herein, 'operative rotational direction of the developer roll' refers to the direction of rotation of the developer roll during normal printing operation. This rotation of the developer roll generates force components on the curved rotary seal portion. The protrusions serve as a restrictive element that provide a 'bite' or a locking arrangement to arrest the end seal in position on the housing, thereby avoiding slippage of the seal and leakage of the toner. In some embodiments, the protrusions are arranged in series along the operative rotational direction of the developer roll. In some embodiments, the protrusions extend throughout a length of the pocket portion along the operative rotational direction of the developer roll. In some embodiments, the protrusions include multiple stair steps that are positioned to interfere with the outer circumferential surface of the curved rotary seal portion to restrict movement of the end seal along the operative rotational direction of the developer roll.

In some embodiments, the protrusions include multiple saw-tooth structures that are positioned to interfere with the outer circumferential surface of the curved rotary seal portion to restrict movement of the end seal along the operative rotational direction of the developer roll. In some embodiments, the protrusions include multiple ribs that are positioned to interfere with the outer circumferential surface of the curved rotary seal portion to restrict movement of the end seal along the operative rotational direction of the developer roll.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
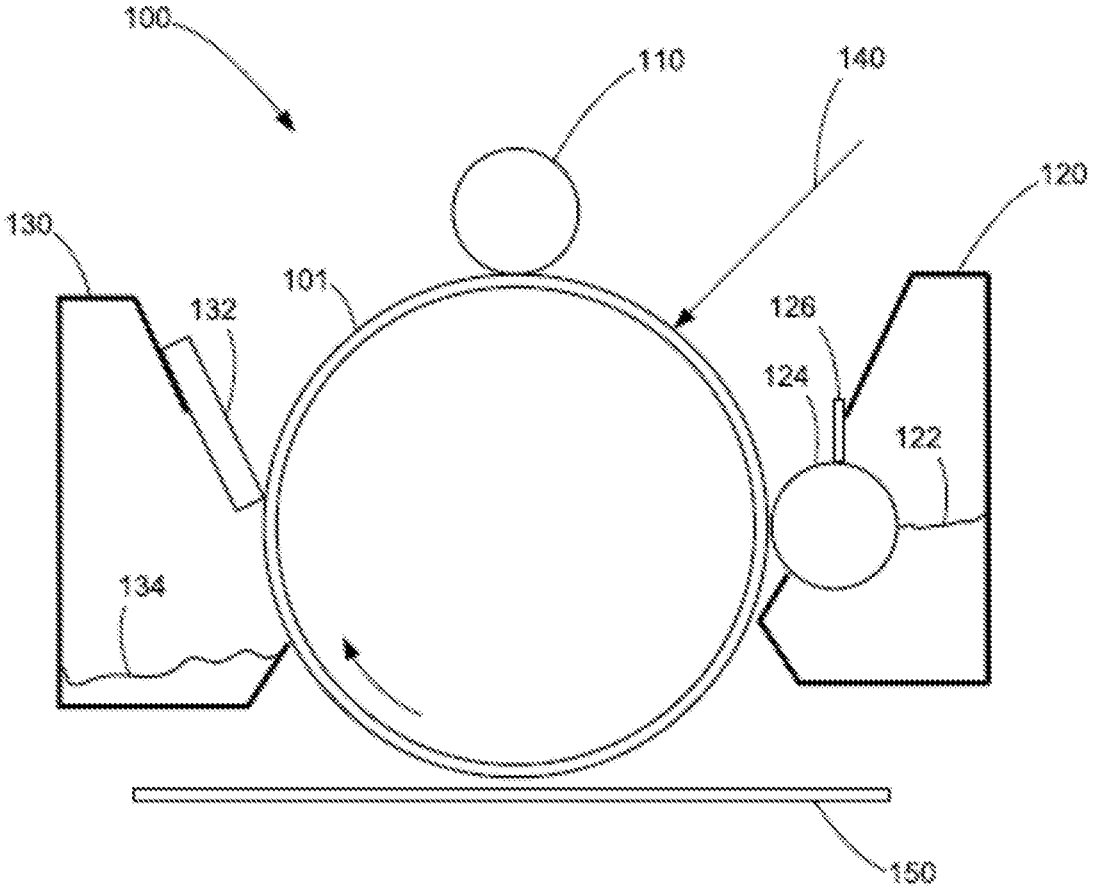
FIG. 1 is a schematic view of an electrophotographic image forming device according to one example embodiment.

FIG. 1 illustrates a schematic representation of an example electrophotographic image forming device 100. Image forming device 100 includes a photoconductive drum 101, a charge roll 110, a developer unit 120 and a cleaner unit 130. The electrophotographic printing process is well known in the art and, therefore, is described briefly herein. During a print operation, charge roll 110 charges the surface of photoconductive drum 101. The charged surface of photoconductive drum 101 is then selectively exposed to a laser light source 140 to form an electrostatic latent image on photoconductive drum 101 corresponding to the image being printed. Charged toner from developer unit 120 is picked up by the latent image on photoconductive drum 101 creating a toned image.

Developer unit 120 includes a toner reservoir 122 having toner particles stored therein and a developer roll 124 that supplies toner from toner reservoir 122 to photoconductive drum 101. Developer roll 124 is electrically charged and electrostatically attracts the toner particles from toner reservoir 122. A doctor blade 126 disposed along developer roll 124 provides a substantially uniform layer of toner on developer roll 124 for subsequent transfer to photoconductive drum 101. As developer roll 124 and photoconductive drum 101 rotate, toner particles are electrostatically transferred from developer roll 124 to the latent image on photoconductive drum 101 forming a toned image on the surface of photoconductive drum 101. In one embodiment, developer roll 124 and photoconductive drum 101 rotate in opposite rotational directions such that their adjacent surfaces move in the same direction to facilitate the transfer of toner from developer roll 124 to photoconductive drum 101. A toner adder roll (not shown) may also be provided to supply toner from toner reservoir 122 to developer roll 124. Further, one or more agitators (not shown) may be provided in toner reservoir 122 to distribute the toner therein and to break up any clumped toner.

The toned image is then transferred from photoconductive drum 101 to print media 150 (e.g., paper) either directly by photoconductive drum 101 or indirectly by an intermediate transfer member. A fusing unit (not shown) fuses the toner to print media 150. A cleaning blade 132 (or cleaning roll) of cleaner unit 130 removes any residual toner adhering to photoconductive drum 101 after the toner is transferred to print media 150. Waste toner from cleaning blade 132 is held (permanently or temporarily) in a waste toner reservoir 134 in cleaning unit 130. The cleaned surface of photoconductive drum 101 is then ready to be charged again and exposed to laser light source 140 to continue the printing cycle.

The components of image forming device 100 are replaceable as desired. For example, in one embodiment, developer unit 120 is housed in a replaceable unit with photoconductive drum 101, cleaner unit 130 and the main toner supply of image forming device 100. In another embodiment, developer unit 120 is provided with photoconductive drum 101 and cleaner unit 130 in a first replaceable unit while the main toner supply of image forming device 100 is housed in a second replaceable unit. In another embodiment, developer unit 120 is provided with the main toner supply of image forming device 100 in a first replaceable unit and photoconductive drum 101 and cleaner unit 130 are provided in a second replaceable unit. In another embodiment, developer unit 120 is provided in a first replaceable unit, the main toner supply of image forming device 100 is provided in a second replaceable unit and photoconductive drum 101 and cleaner unit 130 are provided in a third replaceable unit. Further, any other combination of replaceable units may be used as desired.

Figure 2:
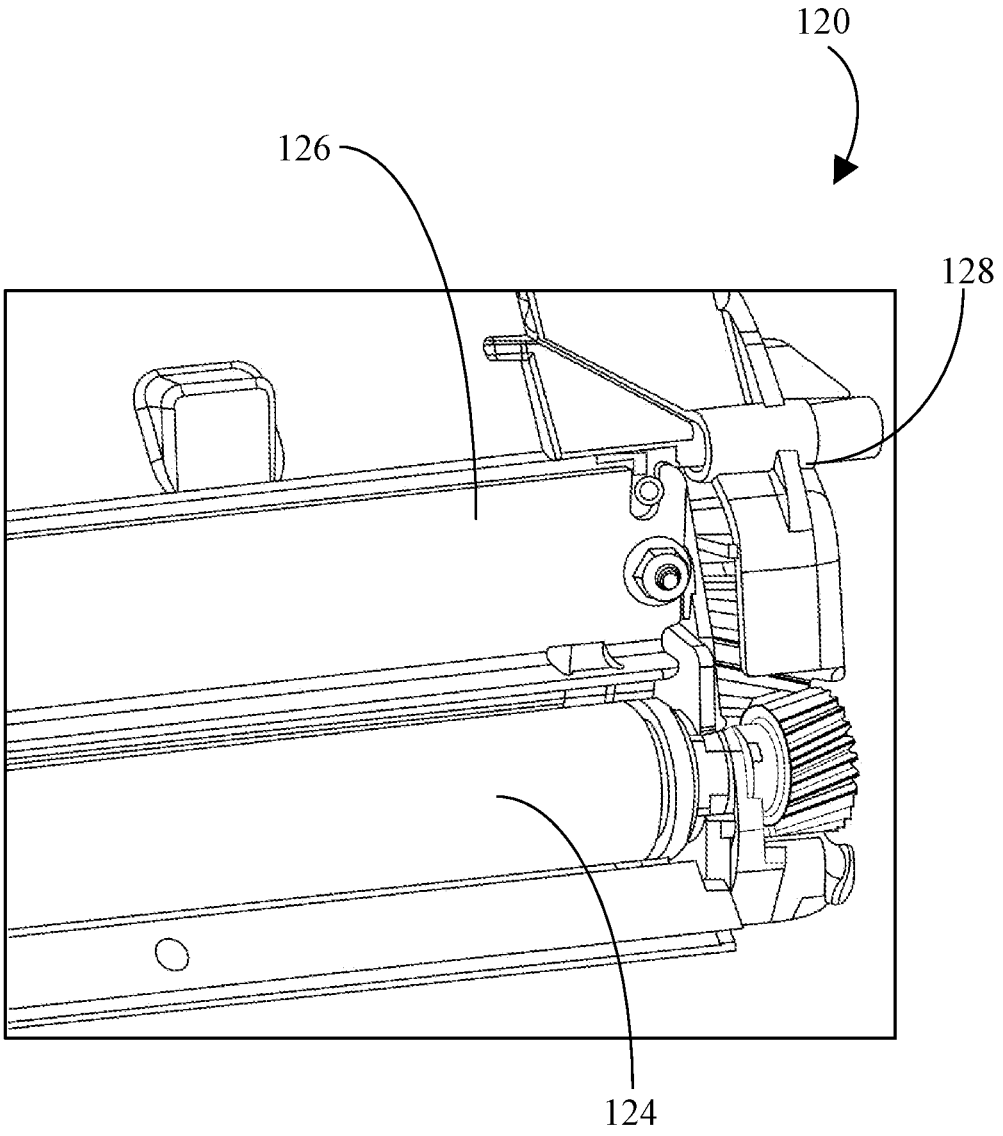
FIG. 2 is a perspective view of a portion of a developer unit according to one example embodiment.
Figure 3:
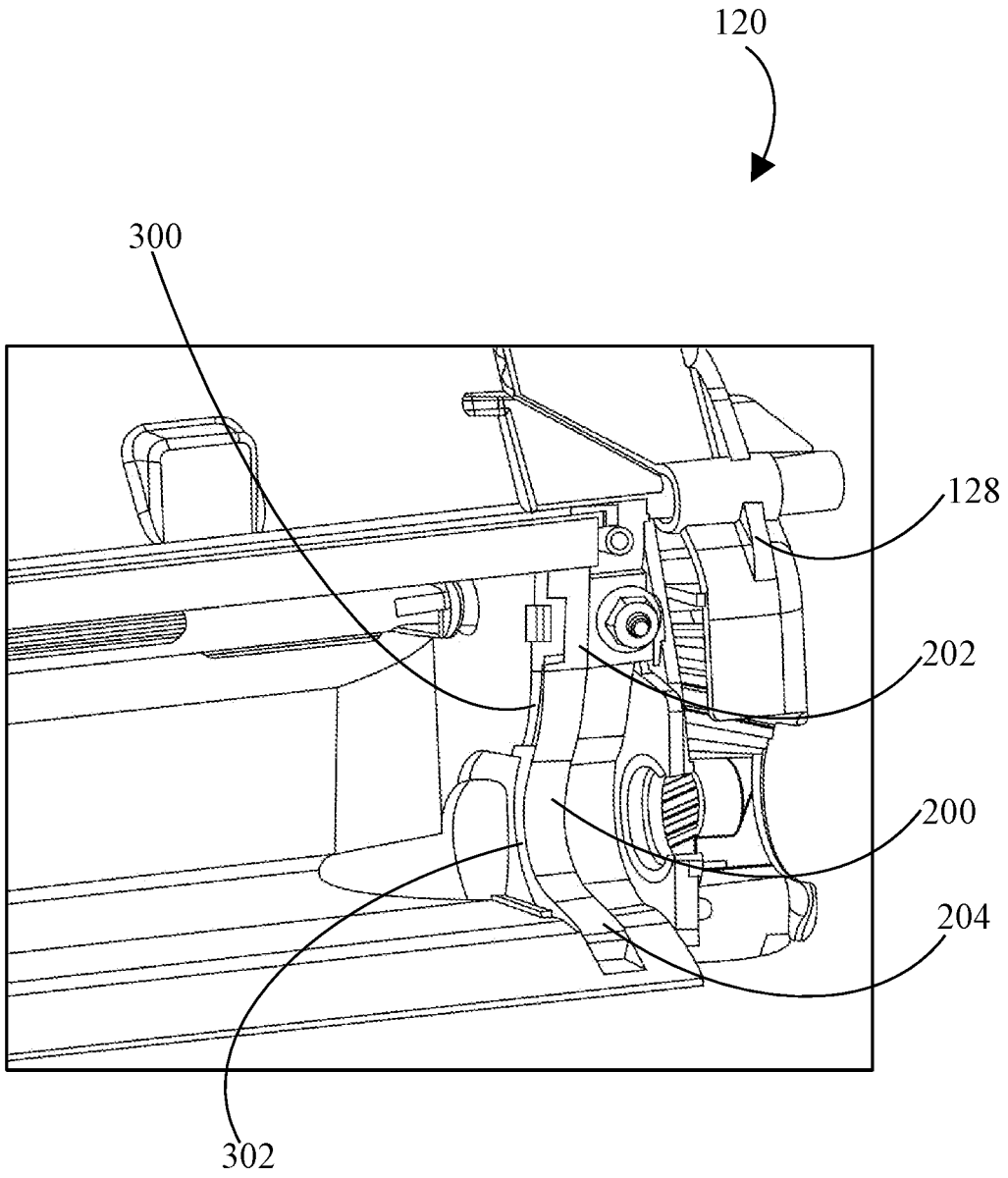
FIG. 3 is a perspective view of the developer unit shown in FIG. 2 with a developer roll, a lower developer seal and a doctor blade omitted to show an end seal according to one example embodiment.

FIG. 2 illustrates an example developer unit 120 including a housing 128 containing developer roll 124 rotatably mounted on housing 128 and doctor blade 126 positioned against developer roll 124. FIG. 3 shows developer unit 120 with developer roll 124 and doctor blade 126 omitted to more clearly illustrate the internal components of developer unit 120. FIG. 3 shows an example end seal 200 positioned in housing 128 at one axial end of developer roll 124. A second end seal (not shown) is positioned at the opposite axial end of developer roll 124 and may be substantially the same as end seal 200. A blade seal portion 202 of end seal 200 is compressed between an interface 300 formed in housing 128 and an end portion of doctor blade 126 (FIG. 2). A curved rotary seal portion 204 of end seal 200 is compressed between a curved interface 302 formed in housing 128 and an axial end portion of developer roll 124 (FIG. 2).

When there is too much interference due to forces generated during rotation of developer roll 124 in contact with end seal 200, end seal 200 may displace creating a leak path for toner and potentially damaging image forming device 100. In order to address this problem, FIGS. 4A-7 illustrate a mechanical lock in the form of protrusions 216 positioned on a pocket portion 210 of housing 128 that are configured to interlock with a foam body 401 (FIGS. 4A and 4B) of end seal 200 in order to restrict motion of end seal 200. Protrusions 216 are configured to interfere with foam body 401 permitting end seal 200 to, for example, create a 'biting action' that resists forces generated by the rotation of developer roll 124 that could tend to displace end seal 200 as discussed in greater detail below.

Figure 4B:
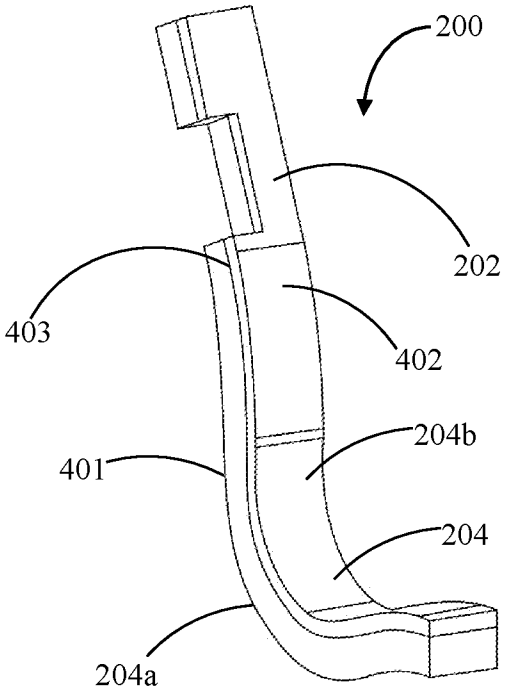
FIG. 4B is a perspective view of the end seal shown in FIG. 4A in a deflected position according to one example embodiment.
Figure 4A:
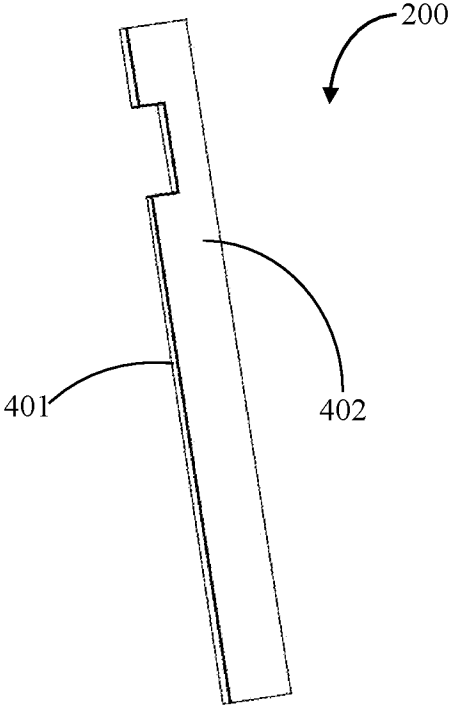
FIG. 4A is a perspective view of the end seal in a non-deflected position according to one example embodiment.

FIG. 4A is a perspective view of end seal 200 in an undeflected position according to one example embodiment, and FIG. 4B is a perspective view of end seal 200 in a deflected position according to one example embodiment. End seal 200 includes a foam body 401 on a back portion of end seal 200 that forms outer circumferential surface 204*a* of curved rotary seal portion 204. In some embodiments, end seal 200 includes a fibrous body 402 on a front portion of end seal 200 that is adhered to foam body 401 by an adhesive 403. Fibrous body 402 forms a sealing surface of end seal 200 including an inner circumferential surface 204*b* of rotary seal portion 204 that contacts developer roll 124. Foam body 401 and fibrous body 402 may be, for example, stamped or die cut. As an example, end seal 200 is manufactured flat and is installed in an arch-shaped pocket around the outer surface of developer roll 124. In other embodiments, end seal 200 includes an elastomeric body forming a sealing surface of end seal 200 in place of fibrous body 402.

Figure 5:
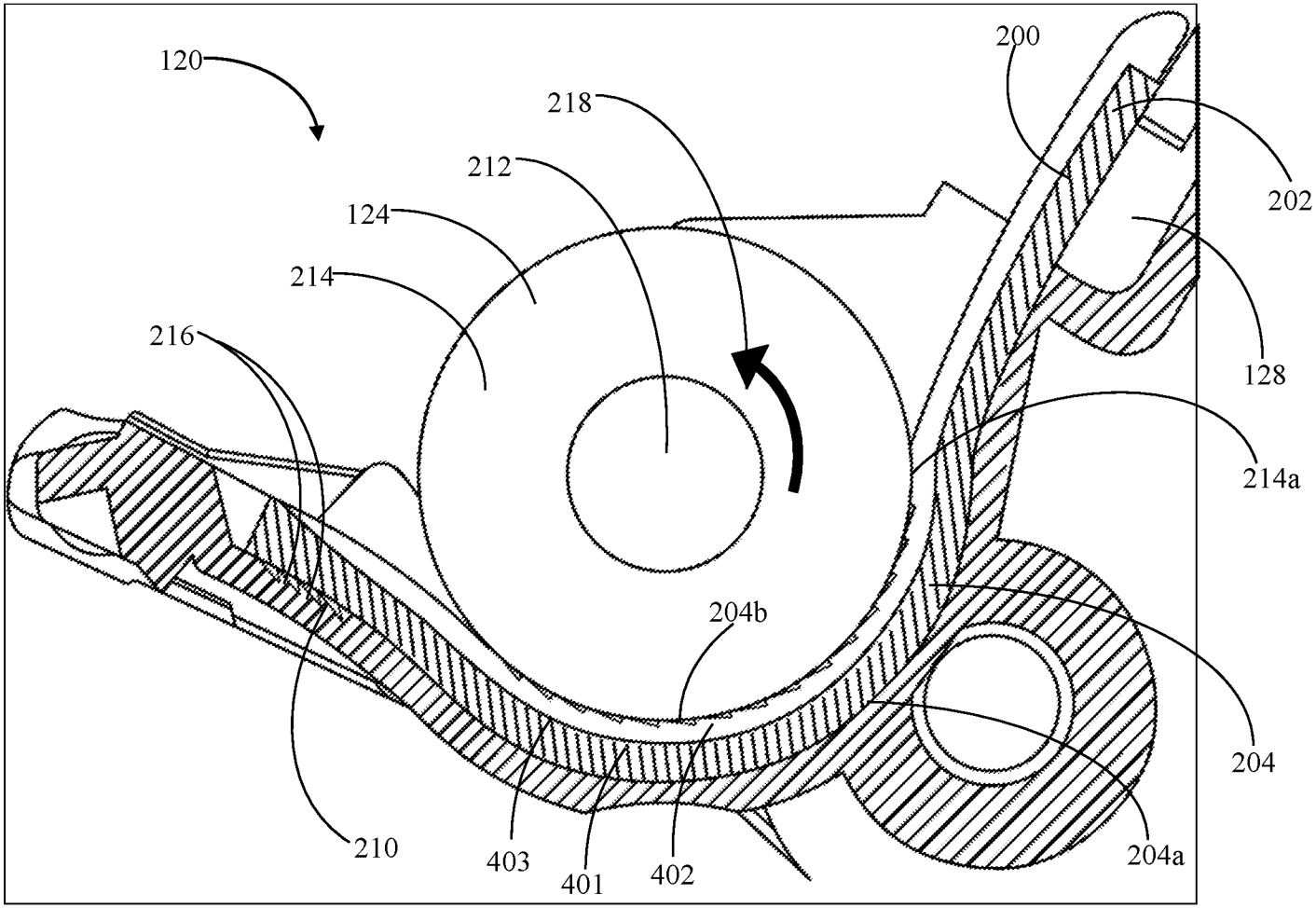
FIG. 5 is a partial sectional side view of the developer unit shown in FIGS. 2 and 3 according to one example embodiment.

FIG. 5 is a partial sectional side view of developer unit 120 according to one example embodiment. Developer unit 120 includes housing 128, developer roll 124, end seal 200 and a pocket portion 210 formed on housing 128. Developer roll 124 is rotatably mounted on housing 128, and developer roll 124 includes a shaft 212 that defines a rotational axis of developer roll 124. Developer roll 124 also includes a roll body 214 that is cylindrically disposed around shaft 212 and that forms an outer circumferential surface 214*a* of developer roll 124. End seal 200 includes curved rotary seal portion 204 that is sandwiched between pocket portion 210 of housing 128 and outer circumferential surface 214*a* of developer roll 124.

End seal 200 may be referred to as a J-seal or as J-shaped seal due to its substantially straight blade seal portion 202 and connecting curved rotary seal portion 204. End seal 200 prevents toner from leaking at axial ends of developer roll 124 at the interface between housing 128, developer roll 124 and doctor blade 126. End seal 200 is sandwiched such that an outer circumferential surface 204*a* of curved rotary seal portion 204 contacts pocket portion 210 of housing 128 and an inner circumferential surface 204*b* of curved rotary seal portion 204 contacts outer circumferential surface 214*a* of developer roll 124. Pocket portion 210 of housing 128 includes multiple protrusions 216 that are in contact with outer circumferential surface 204*a* of curved rotary seal portion 204. Protrusions 216 restrict movement of end seal 200 along an operative rotational direction 218 of developer roll 124, as shown in FIG. 5. In some embodiments, pocket portion 210 is integrally formed with housing 128.

Figure 6A:
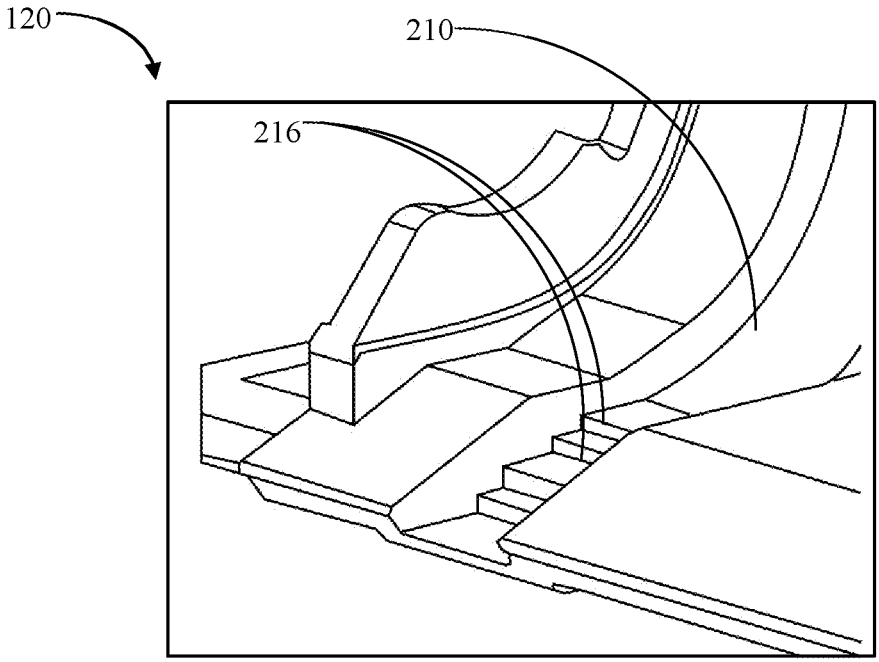
FIG. 6A is a perspective view of the developer unit that shows an arrangement of protrusions in a pocket portion of the developer unit according to a first example embodiment.
Figure 6B:
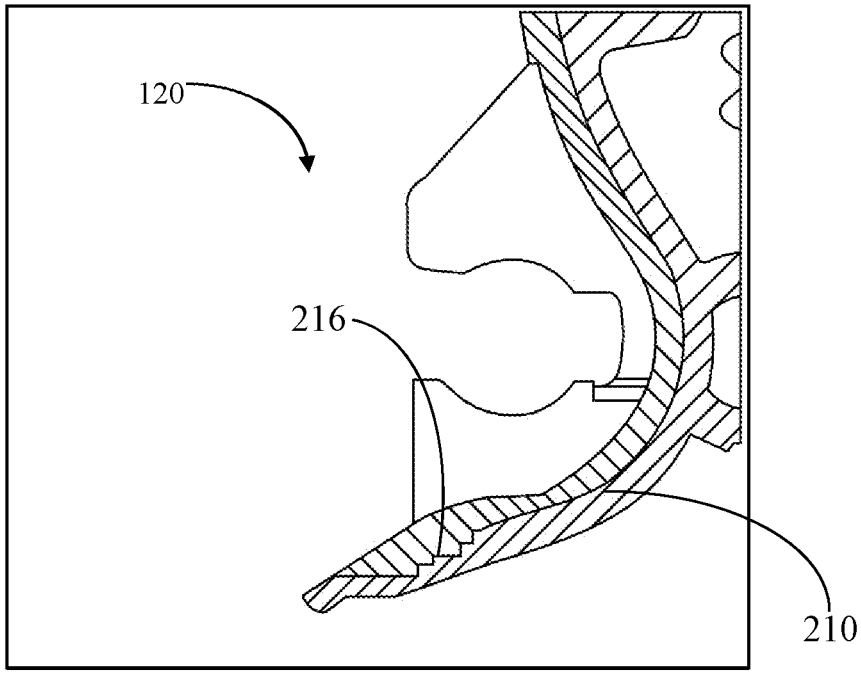
FIG. 6B is a partial sectional view of the developer unit shown in FIG. 6A that shows an arrangement of protrusions in the pocket portion.

FIGS. 6A and 6B show a perspective view and a partial sectional view, respectively, of developer unit 120 that includes an arrangement of protrusions 216 in pocket portion 210 according to a first example embodiment. As shown in FIGS. 6A and 6B, protrusions 216 are arranged in series along operative rotational direction 218 (FIG. 5) of developer roll 124. Protrusions 216 may be arranged in series across pocket portion 210 at any predefined position on pocket portion 210. For example, in the embodiment shown in FIG. 6C, protrusions 216 are arranged to extend throughout a length of pocket portion 210 along operative rotational direction 218 of developer roll 124. Protrusions 216 are constructed or arranged sequentially in series along length of pocket portion 210, so that protrusions 216 offer resistance to end seal 200 in order to prevent end seal 200 from displacing from pocket portion 210 during operation due to the frictional force of rotating developer roll 124.

Figure 6C:
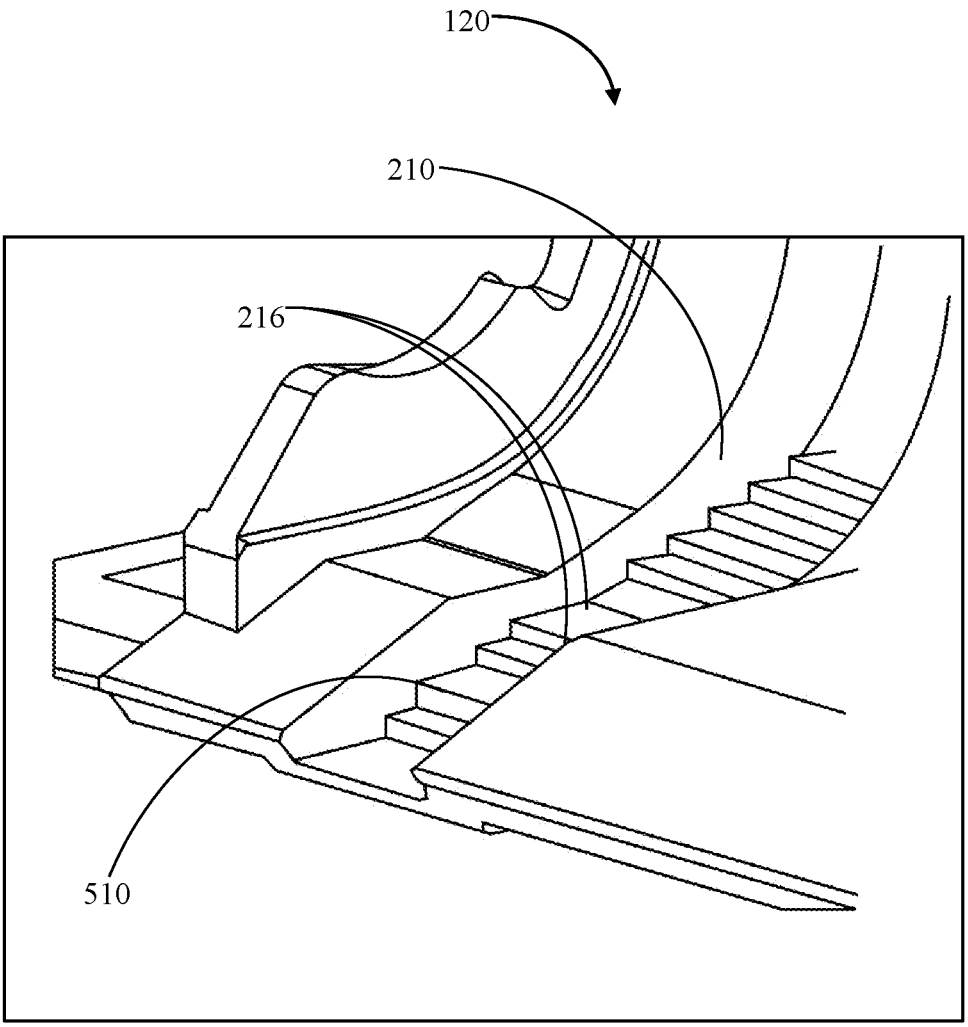
FIG. 6C is a perspective view of the developer unit that shows an arrangement of protrusions as stair steps in the pocket portion according to a second example embodiment.
Figure 6D:
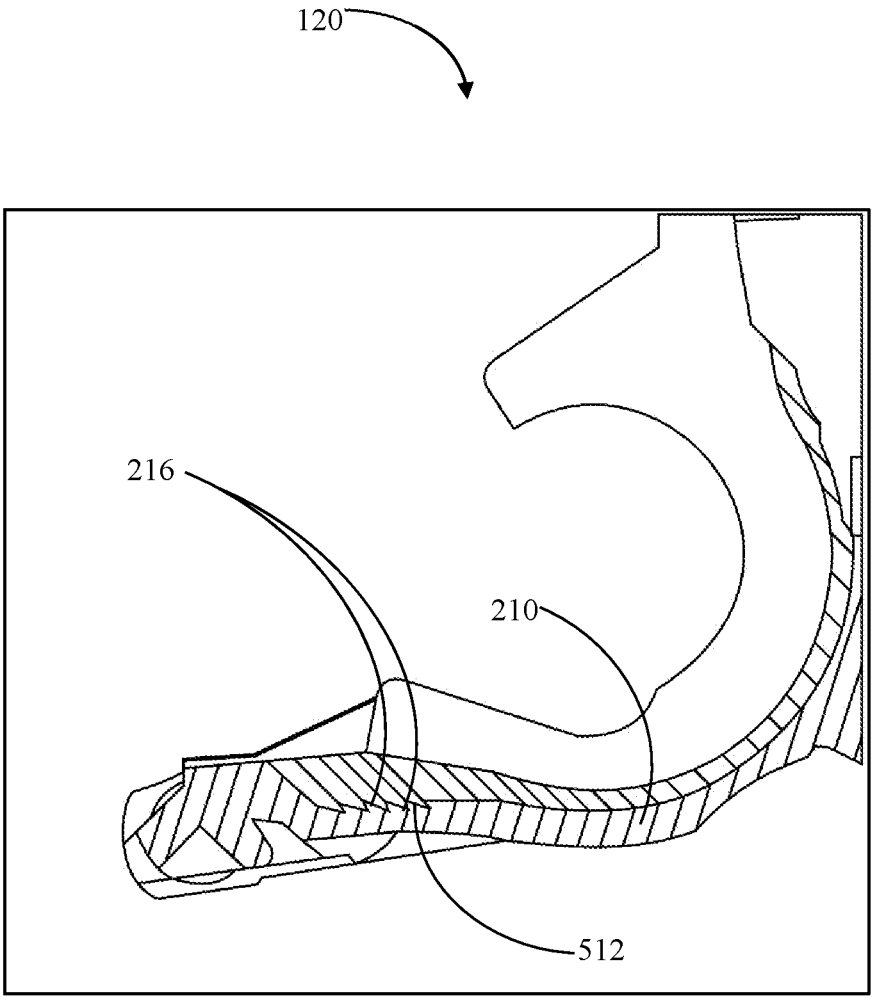
FIG. 6D is a partial sectional view of the developer unit that shows an arrangement of protrusions as saw-tooth structures in the pocket portion according to a third example embodiment.
Figure 6E:
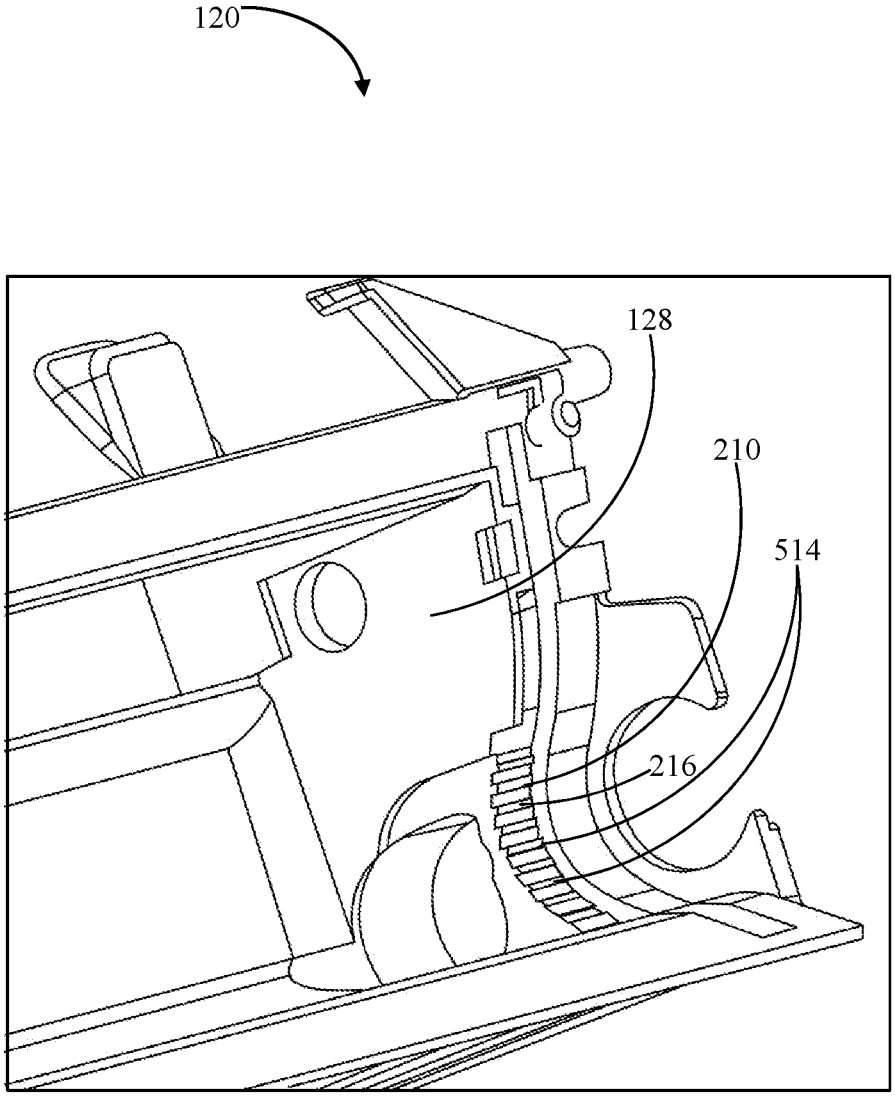
FIG. 6E is a perspective view of the developer unit that shows an arrangement of protrusions as ribs in the pocket portion according to a fourth example embodiment.
Figure 6F:
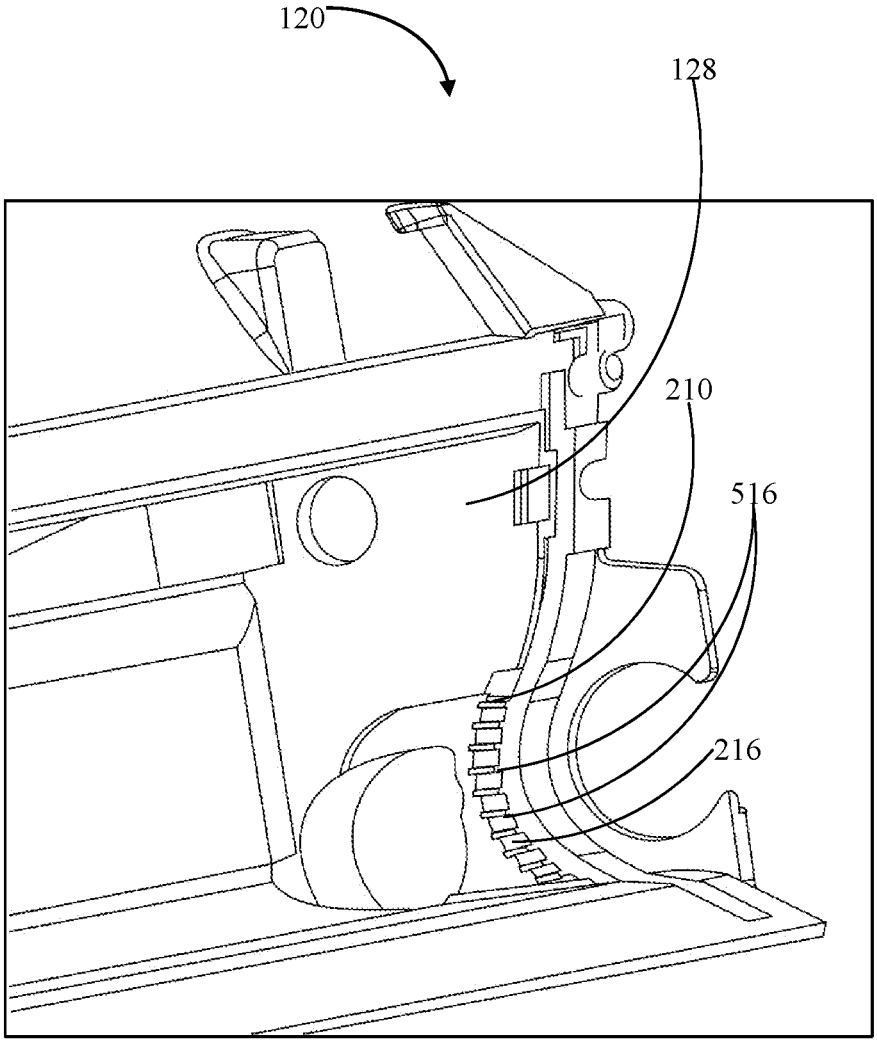
FIG. 6F is a perspective view of the developer unit that shows an arrangement of protrusions formed between slots in the pocket portion according to a fifth example embodiment.

In the embodiments shown in FIGS. 6A-6C, protrusions 216 are constructed in the form of multiple stair steps 510 that are positioned to interfere with outer circumferential surface 204*a* of curved rotary seal portion 204. For example, protrusions 216 are formed in the shape of stair steps 510 that are perpendicular or near perpendicular to restrict motion of end seal 200 along operative rotational direction 218 of developer roll 124. In another embodiment, shown in FIG. 6D, protrusions 216 include multiple saw-tooth structures 512 that are positioned to interfere with outer circumferential surface 204*a* of curved rotary seal portion 204 to restrict movement of end seal 200 along operative rotational direction 218 of developer roll 124. In another embodiment, as shown in FIG. 6E, protrusions 216 include multiple ribs 514 that are positioned to interfere with outer circumferential surface 204*a* of curved rotary seal portion 204 to restrict movement of end seal 200 along operative rotational direction 218 of developer roll 124. In yet another embodiment, as shown in FIG. 6F, protrusions 216 include multiple segments of pocket portion 210 that are positioned between slots 516 and that are positioned to interfere with outer circumferential surface 204*a* of curved rotary seal portion 204 to restrict movement of end seal 200 along operative rotational direction 218 of developer roll 124. These mechanical locking features, such as, for example, stair stepped protrusions 510, saw toothed protrusions 512, ribs 514 and segments between slots 516, contact curved rotary seal portion 204 of end seal 200 to resist movement of end seal 200 along operative rotational direction 128 of developer roll 124 during operation without the need for adhesive or fasteners to adhere or attach end seal 200 to housing 128.

Figure 7:
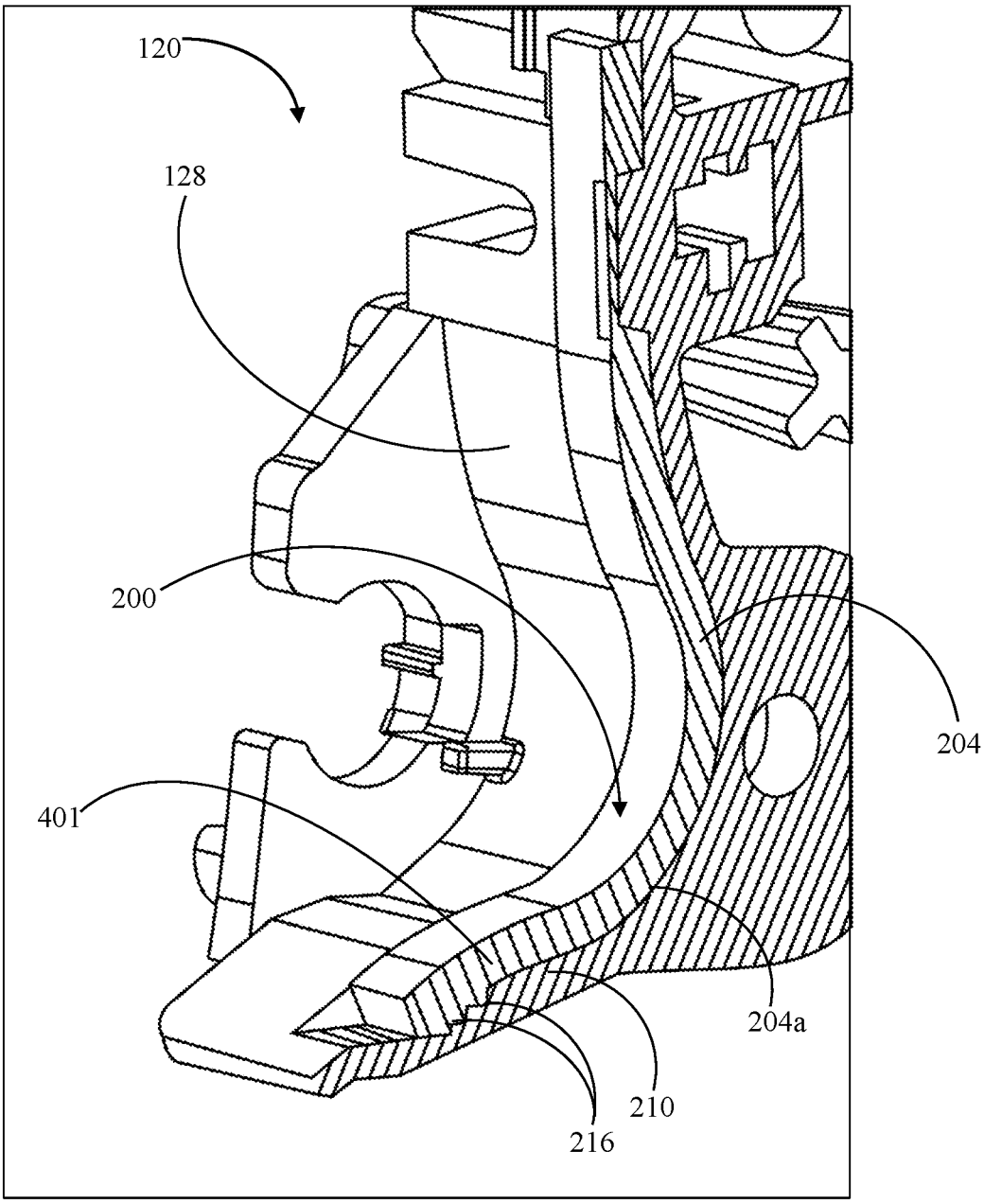
FIG. 7 is a partial sectional view from a top perspective of the developer unit that shows attachment of the end seal over the protrusions in the pocket portion according to one example embodiment.

FIG. 7 is a partial sectional view from a top perspective of developer unit 120 that shows attachment of end seal 200 over protrusions 216 positioned in pocket portion 210 according to one example embodiment. Curved rotary seal portion 204 of end seal 200 includes, for example, a foam body 401 on a back portion of end seal 200 forming outer circumferential surface 204*a* of curved rotary seal portion 204. The force of developer roll 124 against curved rotary seal portion 204 of end seal 200 presses foam body 401 against protrusions 216 to create areas of high compression. The areas of high compression generate increased resistance to hold end seal 200 in position against housing 128 in order to restrict movement of end seal 200 along operative rotational direction 218 of developer roll 124. In some embodiments, peaks of protrusions 216, such as stair steps 510, saw teeth 512, ribs 514 and segments between slots 516, are positioned to align with a nominal pocket depth of pocket portion 210. In other embodiments, peaks of protrusions 216 extend beyond adjacent surfaces of pocket portion 210 in order to provide greater resistance with foam body 401 of end seal 200.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A developer unit for an electrophotographic image forming device, comprising:

a housing;

a developer roll rotatably mounted on the housing, the developer roll including a shaft defining a rotational axis of the developer roll, the developer roll including a roll body cylindrically disposed around the shaft and forming an outer circumferential surface of the developer roll; and an end seal including a curved rotary seal portion, the curved rotary seal portion being sandwiched between a pocket portion of the housing and the outer circumferential surface of the developer roll such that an outer circumferential surface of the curved rotary seal portion contacts the pocket portion of the housing and an inner circumferential surface of the curved rotary seal portion contacts the outer circumferential surface of the developer roll, the pocket portion of the housing including a plurality of protrusions in contact with the outer circumferential surface of the curved rotary seal portion and positioned to restrict movement of the end seal along an operative rotational direction of the developer roll.

2. The developer unit of claim 1, wherein the plurality of protrusions are arranged in series along the operative rotational direction of the developer roll.

3. The developer unit of claim 1, wherein the plurality of protrusions extend throughout a length of the pocket portion along the operative rotational direction of the developer roll.

4. The developer unit of claim 1, wherein the plurality of protrusions include a plurality of stair steps positioned to interfere with the outer circumferential surface of the curved rotary seal portion to restrict movement of the end seal along the operative rotational direction of the developer roll.

5. The developer unit of claim 1, wherein the plurality of protrusions include a plurality of saw-tooth structures positioned to interfere with the outer circumferential surface of the curved rotary seal portion to restrict movement of the end seal along the operative rotational direction of the developer roll.

6. The developer unit of claim 1, wherein the plurality of protrusions include a plurality of ribs positioned to interfere with the outer circumferential surface of the curved rotary seal portion to restrict movement of the end seal along the operative rotational direction of the developer roll.

7. The developer unit of claim 1, wherein the pocket portion is integrally formed with the housing.

* * * * *